US006198343B1

(12) United States Patent
Matsuoka

(10) Patent No.: US 6,198,343 B1
(45) Date of Patent: Mar. 6, 2001

(54) CURRENT MIRROR CIRCUIT

(75) Inventor: Toshiaki Matsuoka, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/405,081

(22) Filed: Sep. 27, 1999

(30) Foreign Application Priority Data

Oct. 23, 1998 (JP) ..... 10-302802

(51) Int. Cl.[7] ..... G05F 3/02
(52) U.S. Cl. ..... 327/543; 327/530; 323/315
(58) Field of Search ..... 327/538, 540, 327/541, 543; 232/312, 315

(56) References Cited

U.S. PATENT DOCUMENTS 4,008,441 * 2/1977 Schrade, Jr. ..... 323/315
4,078,199 * 3/1978 Chapron et al. ..... 323/315
4,801,892 * 1/1989 Yamakoshi et al. ..... 323/315
5,349,286 * 9/1994 Marshall ..... 323/315
5,394,079 * 2/1995 Llewellyn ..... 323/315
5,512,815 * 4/1996 Schrader ..... 323/315
5,525,927 * 6/1996 Yung et al. ..... 327/543
5,818,292 * 10/1998 Slemmer ..... 327/541

FOREIGN PATENT DOCUMENTS 6-104762 4/1994 (JP) .

* cited by examiner

*Primary Examiner*—Terry D. Cunningham

(57) ABSTRACT

The current mirror circuit in accordance with the present invention includes a first current mirror circuit composed of first and second MOS transistors being cascade connected to a second current mirror circuit composed of third and fourth MOS transistors. Further, an NPN transistor is interposed between the gate and the drain of the third MOS transistor to which an input current is supplied. Thus, the third MOS transistor can operate normally even with a higher input voltage than in a case where the drain is connected to the gate by as much as the base-emitter voltage of the NPN transistor. In addition, even if the input current is in an off state, electric charge always flows out via the gates of the first and second MOS transistors as the base current of the NPN transistor. Thus, a current mirror circuit can be offered with high precision in output current and a short rise-time when changed from an on state to an off state, while maintaining a wide input voltage range.

17 Claims, 10 Drawing Sheets

CURRENT MIRROR CIRCUIT

FIELD OF THE INVENTION

The present invention relates to current mirror circuits, more particularly, current mirror circuits with a BiCMOS structure.

BACKGROUND OF THE INVENTION

Conventionally, current mirror circuits composed of MOS transistors are typically cascade connected to improve precision in the output current of the current mirror circuits.

For example, referring to the current mirror circuit section 104 shown in FIG. 8, in a first stage current mirror circuit, the gates of Pch MOS transistors P101 and P102 are connected to each other, and also to the drain of an MOS transistor P101. While a power source voltage $V_{cc}$ is applied to the sources of the two MOS transistors P101 and P102, the drains thereof are connected to the respective sources of MOS transistors P103 and P104 that constitute a next stage current mirror circuit.

In addition, the gates of the two MOS transistors P103 and P104 are connected to each other, and further connected to the drain of the MOS transistor P103 that serves as a current input terminal T105. Thus, as a predetermined current $I_{in}$ is supplied from a current source 105 via the current input terminal T105, the current mirror circuit section 104 is capable of producing an output current $I_{out}$, of the same value as the current $I_{in}$, flowing via the drain of the MOS transistor P104 which serves as a current output terminal T106.

In the arrangement above, since the two current mirror circuits are cascade connected, the drain potentials of the MOS transistors P101 and P102 are both equal to the sum of the gate potential of the MOS transistors P103 and P104 and a threshold voltage $V_{th}$, and are thereby equal to each other. As a result, current fluctuations caused by Early effect are restrained, and the precision of the output current $I_{out}$ can be improved.

Nevertheless, in the current mirror circuit section 104 in the arrangement, so as to allow each current mirror circuit to operate in the saturation region thereof, the gate-drain voltages of the MOS transistors P101 to P104 need to be held at a value not less than the threshold voltage $V_{th}$. Therefore, the input and output voltage ranges of the current mirror circuit section 104 are limited from GND to $V_{cc}-2V_{th}$, where $V_{cc}$ is the power source voltage and GND is the ground level. Cascade connection narrows down the operating voltage range in this manner, which is an obstacle in lowering the voltage of the power source.

In order to widen the operating voltage range while maintaining the output precision of the current mirror circuit, Japanese Laid-Open Patent Application No. 6-104762/1994 (Tokukaihei 6-104762) and other documents disclose a current mirror circuit section 104*a* to which a bias voltage power source 106 is provided as shown in FIG. 9, for example. Pch MOS transistors P111 and P112 of which the gates are connected to each other, as well as Pch MOS transistors P113 and P114 of which the gates are connected to each other, are provided to the current mirror circuit section 104*a*, and the drain of the MOS transistor P113 is connected to the gates of the MOS transistors P111 and P112. Meanwhile, the gates of the MOS transistors P113 and P114 are both connected to the bias voltage power source 106 so that the MOS transistors P111 to P114 are fed with a voltage that allows the MOS transistors P111 to P114 to operate in the saturation regions thereof.

Note that, similarly to the case of the current mirror circuit section 104 shown in FIG. 8, the power source voltage $V_{cc}$ is applied to the sources of the two MOS transistors P111 and P112; the drain of the MOS transistor P111 is connected to the source of the MOS transistor P113; and the drain of the MOS transistor P112 is connected to the source of the MOS transistor P114.

In the preceding arrangement, since the gate of the MOS transistor P111 is connected to the drain of the MOS transistor P113, the input voltage range of the current mirror circuit section 104*a* is from GND to $V_{cc}-V_{th}$, thereby having become wider than that of the current mirror circuit section 104 shown in FIG. 8 by a value equivalent to the threshold voltage $V_{th}$. In addition, since the gate voltages of the two MOS transistors P113 and P114 are adjusted by the bias voltage power source 106 so that the MOS transistors P111 to P114 operate in the saturation regions thereof, the source voltages of the two MOS transistors P113 and P114, i.e., the drain voltages of the two MOS transistors P111 and P112, become equal to each other. As a result, the source-drain voltage Vds of the two MOS transistors P111 and P112 become equal to each other. Therefore, the precision of the output current $I_{out}$ can be relatively improved compared to use of a single current mirror circuit.

However, in the current mirror circuit section 104*a* having such an arrangement, if a variation in a property occurring during manufacture results in a difference (offset) in the gate lengths of the MOS transistors P111 and P112, the offset degrades the precision of the output current $I_{out}$.

More specifically, when the current mirror circuit section 104*a* is manufactured, non-uniformity occurring during wafer manufacturing causes in many cases differences in properties of the two MOS transistors P111 and P112. Especially, for example, if there occurs a difference in threshold voltage $V_{th}$ due to a difference in gate length, one of the two MOS transistors P111 and P112, which has a higher threshold voltage $V_{th}$ than the other, will generate a smaller current, and there occurs a difference between the input current $I_{in}$, and the output current $I_{out}$.

Here, if the gate lengths of the two MOS transistors P111 and P112 are specified to a large value, adverse effects of the offset can be reduced. Nevertheless, in such a case, the gate parasitic capacity of the two MOS transistors P111 and P112 increases. As a result, a new problem arises where feeding of the output current $I_{out}$ does not immediately takes place when the input current $I_{in}$ is introduced.

More specifically, when the input current $I_{in}$ is in an off state, the MOS transistors P111 to P114 are also maintained in an off state. Here, when the input current $I_{in}$ starts flowing, electric charges stored in the gate parasitic capacity of the two MOS transistors P111 and P112 are discharged, which reduces the gate voltage. Once a point is reached where the gate-source voltage $V_{gs}$ exceeds the threshold voltage $V_{th}$ (when the condition, $V_{gs}>V_{th}$, is satisfied), the two MOS transistors P111 and P112 conduct, and the output current $I_{out}$ changes into an on state. Here, since the gate lengths are specified to a large value to reduce the adverse effects of the offset, the gate parasitic capacity also has a large value. Therefore, feeding of the output current $I_{out}$ does not immediately takes place when the input current $I_{in}$ is introduced. As an example, if the gate parasitic capacity of the two MOS transistors P111 and P112 is 5 [pF], as shown in FIG. 10, feeding of the output current $I_{out}$ takes place about 1 [$\mu$s] after the input current $I_{in}$ of 5 [$\mu$A] is introduced.

Note that in a non-cascade-connected single current mirror circuit, the adverse effects of the offset of the two MOS transistors can be restrained by applying the power source voltage $V_{cc}$ to the sources of the two MOS transistors via resistors of the same resistance value. Nevertheless, in the conventional current mirror circuit section 104*a* shown in FIG. 9, if resistors are connected to the sources of the MOS transistors P111 and P112, since the voltage drop across the resistor varies depending on the input current $I_{in}$, the source voltages of the MOS transistors P111 to P114 fluctuates depending on the input current $I_{in}$. As a result, the gate voltages of the MOS transistors P113 and P114 need to be either increased or reduced through control of the bias voltage power source 106 according to the input current $I_{in}$, so as to allow the MOS transistors P111 to P114 to operate in the saturation regions.

Note that if the gate voltage is fixed, and the input current $I_{in}$ is small, since the gate voltage of the MOS transistor P111 increases, the gate voltages of the MOS transistors P113 and P114 also increase, which prohibits the MOS transistors P113 and P114 to operate in the saturation regions thereof. In addition, if the input current $I_{in}$ further decreases, and the drain voltage of the MOS transistor P113 increases, since the source voltage of the MOS transistor P113, i.e., the drain voltage of the MOS transistor P111, increases, the two MOS transistors P111 and P112 lose current balance due to Early effect. In such a state, since the currents flowing through the two MOS transistors P111 and P112 are varied by a small fluctuation in the drain-source voltage $V_{ds}$ thereof, the precision of the output currents $I_{out}$ of the two MOS transistors P111 and P112 are greatly degraded. As a result, if the aforementioned resistors are to be interposed in the arrangement shown in FIG. 9, the gate voltage needs to be controlled through control of the bias voltage power source 106 depending upon the input current $I_{in}$, which results in a complex circuit arrangement.

SUMMARY OF THE INVENTION

The present invention, conceived of to solve those problems briefly mentioned above, has an object to offer a current mirror circuit capable of generating highly precise output current in a short rise-time when an input current changes from an off state to an on state, while maintaining a wide input voltage range.

A current mirror circuit in accordance with the present invention, in order to achieve the above object, includes:

- a first current mirror circuit composed of first and second MOS transistors;
- a second current mirror circuit, composed of third and fourth MOS transistors, which is cascade connected to the first current mirror circuit; and
- input dynamic range widening means for discharging electric charges stored in a gate parasitic capacity of the first and second MOS transistors and for rendering the third MOS transistor to have a higher gate potential than a drain potential by a predetermined amount.

The output current of the current mirror circuit fluctuates due to non-uniformity in properties of the first and second MOS transistors (non-uniformity in properties occurring during manufacture). The gate lengths of the first and second MOS transistors are set to a large value to restrain the fluctuations, and the adverse effects of the offset can thereby be reduced. However, if the gate lengths are set to a large value, the gate parasitic capacity increases, and an output current does not immediately start flowing when an input current is applied.

Accordingly, with the arrangement, the input dynamic range widening means discharges electric charges stored in the gate parasitic capacity of the first and second MOS transistors. Thus, even if the gate lengths are set to a large value, when the input current changes into an on state, electric charges stored in the gate parasitic capacity do not need be discharged via the gates of the first and second MOS transistors. This ensures that the rise-time of the current mirror circuit is shortened. Therefore, it is ensured that the current mirror circuit is realized with capabilities to generate a highly precise output current in a short rise-time, even if there exists the aforementioned non-uniformity in properties occurring during manufacture.

Also, with the arrangement, the input dynamic range widening means renders the first MOS transistor to have a higher drain potential than a gate potential by a predetermined amount. This ensures that the input dynamic range widens by an amount equivalent to the potential of the predetermined amount.

For a fuller understanding of the nature and advantages of the invention, reference should be made to the ensuing detailed description taken in conjunction with the accompanying drawings.

DESCRIPTION OF THE EMBODIMENTS

Now, referring to FIG. 1 through FIG. 7, the following description will discuss an embodiment in accordance with the present invention.

Figure 2:
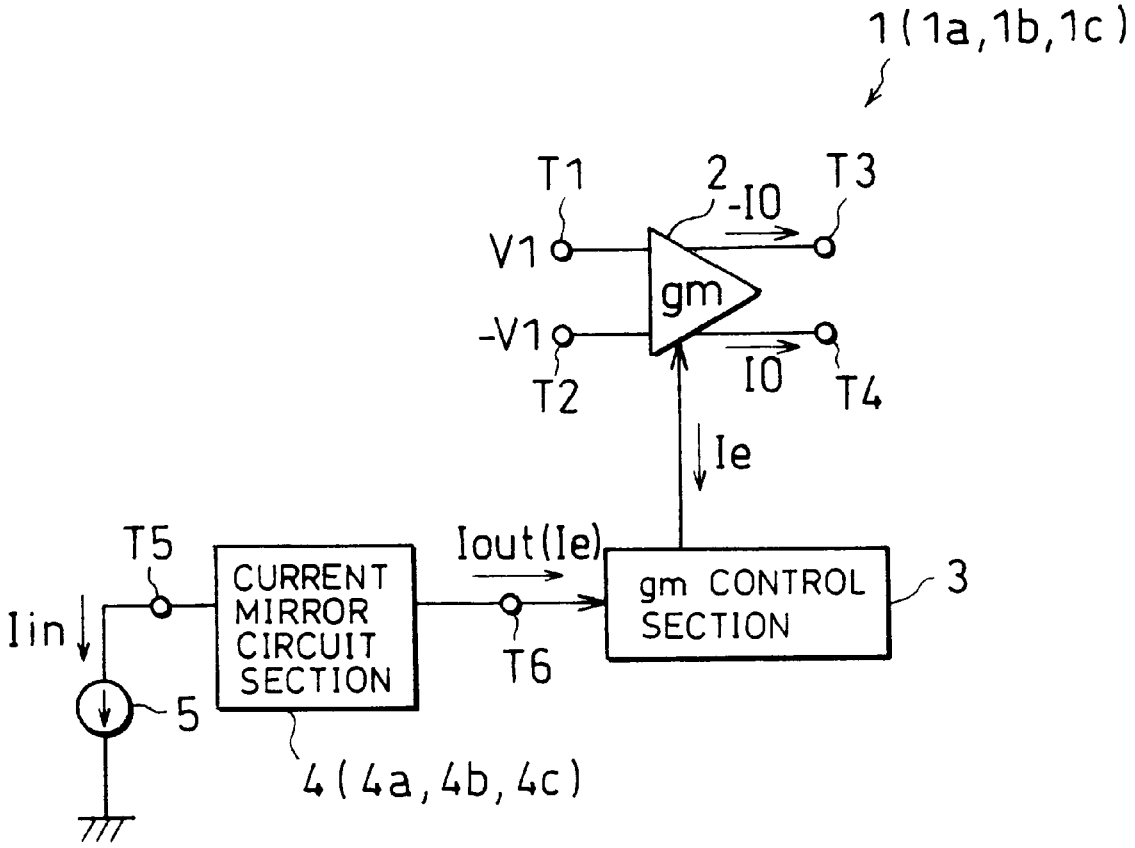
FIG. 2 is a block diagram showing an arrangement of a major part of a mutual conductance amplifier incorporating the current mirror circuit section.

A mutual conductance amplifier 1 of the present embodiment is, for example, an amplifier suitably used as a filter in a read/write controller of a floppy disk drive. The mutual conductance, gm, between voltage input terminals T1 and T2 and current output terminals T3 and T4 of an amplifier section 2 is, as shown in FIG. 2, controlled by a gm control section 3 according to the current $I_{out}$ (=$I_e$) that flows from a control-use current source 5 via a current mirror circuit section 4, for example.

Here, the current mirror circuit section (current mirror circuit) 4 of the present embodiment, as will be detailed later, is not only capable of highly precisely and quickly controlling the output current $I_{out}$ according to the input current $I_{in}$, but has a wider input voltage range (dynamic range). Thus, the mutual conductance amplifier 1 is capable of highly precise and quickly controlling the mutual conductance gm using the control-use current source 5 boasting a wider dynamic range. As a result, when the mutual conductance amplifier 1 is used as a filter, the frequency property, f0, of the filter can be quickly and highly precisely controlled.

Figure 1:
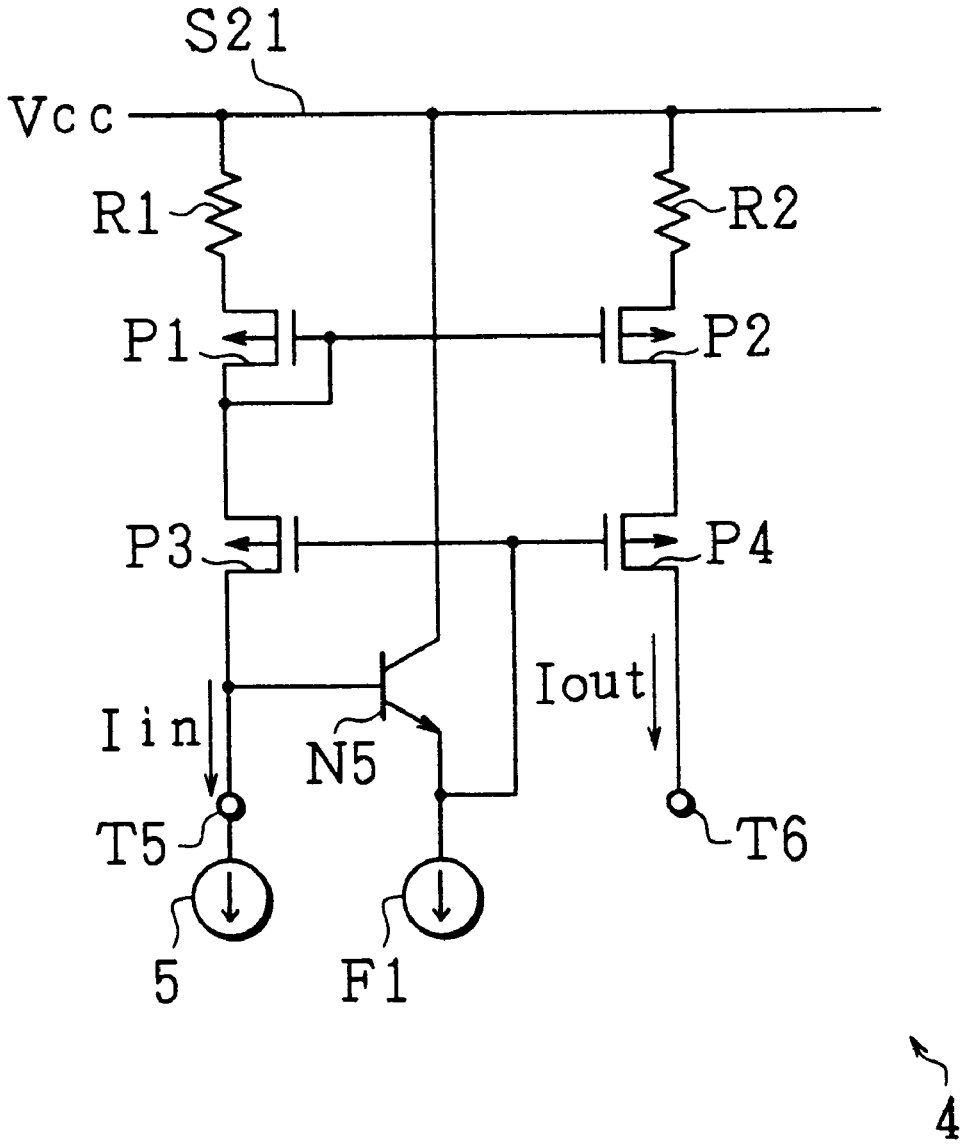
FIG. 1, in reference to an embodiment in accordance with the present invention, is a circuit diagram showing an arrangement of a major part of a current mirror circuit section.

More specifically, the current mirror circuit section 4 of the present embodiment is a circuit of a BiCMOS structure, and includes, as current mirror circuits cascade connected, Pch MOS transistors (first and second MOS transistors) P1 and P2 of which the gates are connected to each other, and Pch MOS transistors (third and fourth MOS transistors) P3 and P4 of which the gates are connected to each other, as shown in FIG. 1. The drain of the MOS transistor P1 is connected to the gate thereof, and further connected to the source of the MOS transistor P3 constituting the next stage current mirror circuit. In addition, the drain of the MOS transistor P2 is connected to the source of the MOS transistor P4. Further, the drain, of the MOS transistor P3, which serves as a control current input terminal T5 is connected to the control-use current source 5, whereas the drain, of the MOS transistor P4, which serves as a control current output terminal T6 is connected to the gm control section 3 shown in FIG. 2.

In addition, in the current mirror circuit section 4 of the present embodiment, an NPN transistor (first bipolar transistor) N5 given a bias by a constant current source (first bias current source) F1 is interposed between the drain of the MOS transistor P3 and the gates of the two MOS transistors P3 and P4. The base of the NPN transistor N5 is connected to the drain of the MOS transistor P3, and a power source voltage $V_{cc}$ is applied to the collector thereof. In addition, the emitter is connected to the gates of the two MOS transistors P3 and P4 and also to the constant current source F1.

Besides, the current mirror circuit section 4 includes resistors R1 and R2, and the sources of the two MOS transistors P1 and P2 are connected via the respective resistors R1 and R2 to a power source line (first power source line) S21 to which the power source voltage $V_{cc}$ is applied.

With the arrangement, since the two current mirror circuits are cascade connected, the drain voltages of the two MOS transistors P1 and P2 constituting the first stage current mirror circuit are equal to the sum of the gate voltage of the MOS transistors P3 and P4 constituting the second stage current mirror circuit and the threshold voltage $V_{th}$, and therefore become equal to each other. This restrains current fluctuations caused by Early effect, and therefore reduces the difference between the input current $I_{in}$, and the output current $I_{out}$, i.e., improves the precision of the output current $I_{out}$.

Further, in the current mirror circuit section 4 of the present embodiment, an NPN transistor N5 given a bias by the constant current source F1 is interposed between the gates of the two MOS transistors P3 and P4 and the drain of the MOS transistor P3.

The base-emitter voltage, $V_{BE}$, of the NPN transistor N5 renders the drain voltage of the MOS transistor P3 higher than the gate voltages of the two MOS transistors P3 and P4. Therefore, even if the voltage Vin of the control current input terminal T5 increases, the two MOS transistors P3 and P4 can continue to operate normally without changing to an off state. As a result, the input voltage range (dynamic range) of the current mirror circuit section 4 can become wider than that of the conventional current mirror circuit section 104 shown in FIG. 8 by a value equivalent to the base-emitter voltage, $V_{BE}$, of the NPN transistor N5.

In addition, the provision of the NPN transistor N5 allows the base current of the NPN transistor N5 to flow through the MOS transistors P1 and P3 even if the control-use current source 5 is in an off state (even if the input current $I_{in}$ is 0). This base current equals $I1/h_{FE}$ where I1 is the current fed from the constant current source F1. Note that $h_{FE}$ is an h parameter of the NPN transistor N5.

As a result, even if the control-use current source 5 is in an off, electric charge flows out via the gates of the two MOS transistors P1 and P2 constituting the first stage current mirror circuit. As a result, unlike the arrangement of the conventional technology shown in FIG. 8 (FIG. 9) where the output current $I_{out}$ does not start flowing until electric charges stored in the gate parasitic capacity of the two MOS transistors P101 and P102 (P111 and P112) are discharged, no time is necessary for electric charges stored in the gate parasitic capacity of the two MOS transistors P1 and P2 to be discharged. Therefore, the time (the rise-time) from the start of the flowing of the input current $I_{in}$ to the start of the flowing of the output current $I_{out}$ can be shortened.

Besides, with the arrangement shown in FIG. 1, even if the control-use current source 5 is in an off state, electric charge flows out to the constant current source F1 through the gates of the two MOS transistors P3 and P4 constituting the second stage current mirror circuit. As a result, no time is necessary for electric charges stored in the gate parasitic capacity of the two MOS transistors P3 and P4 to be discharged. Therefore, the time (the rise-time) from the start of the flowing of the input current $I_{in}$ to the start of the flowing of the output current $I_{out}$ can be shortened further.

Figure 3:
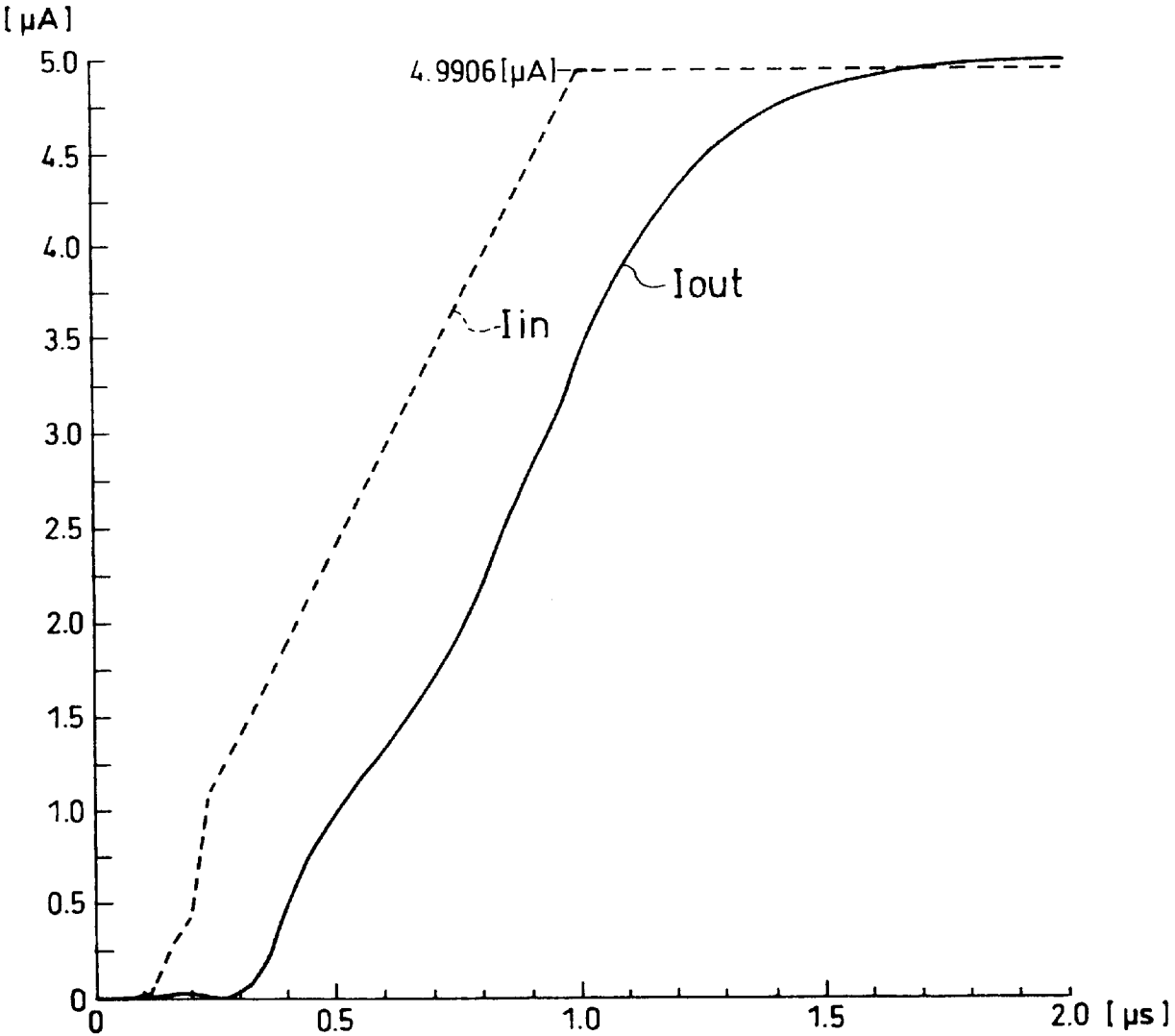
FIG. 3, representing operation of the preceding current mirror circuit section, is a graph of rise properties of the input and output currents.
Figure 9:
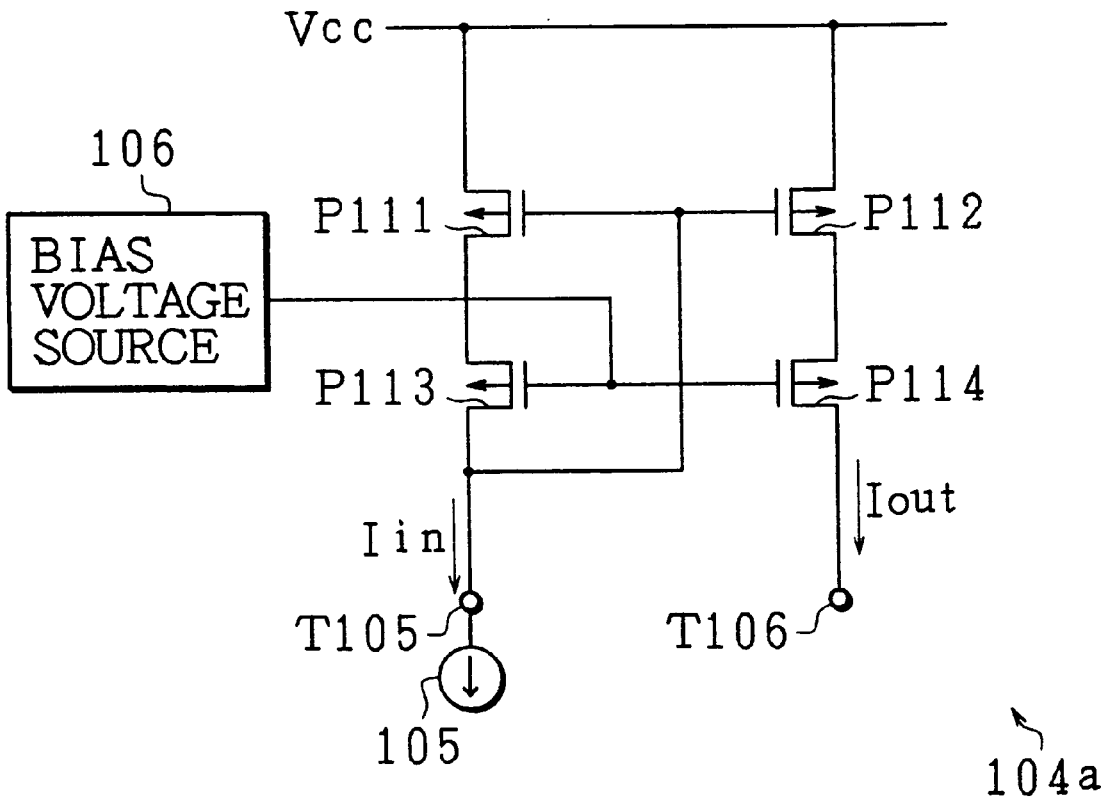
Figure 10:
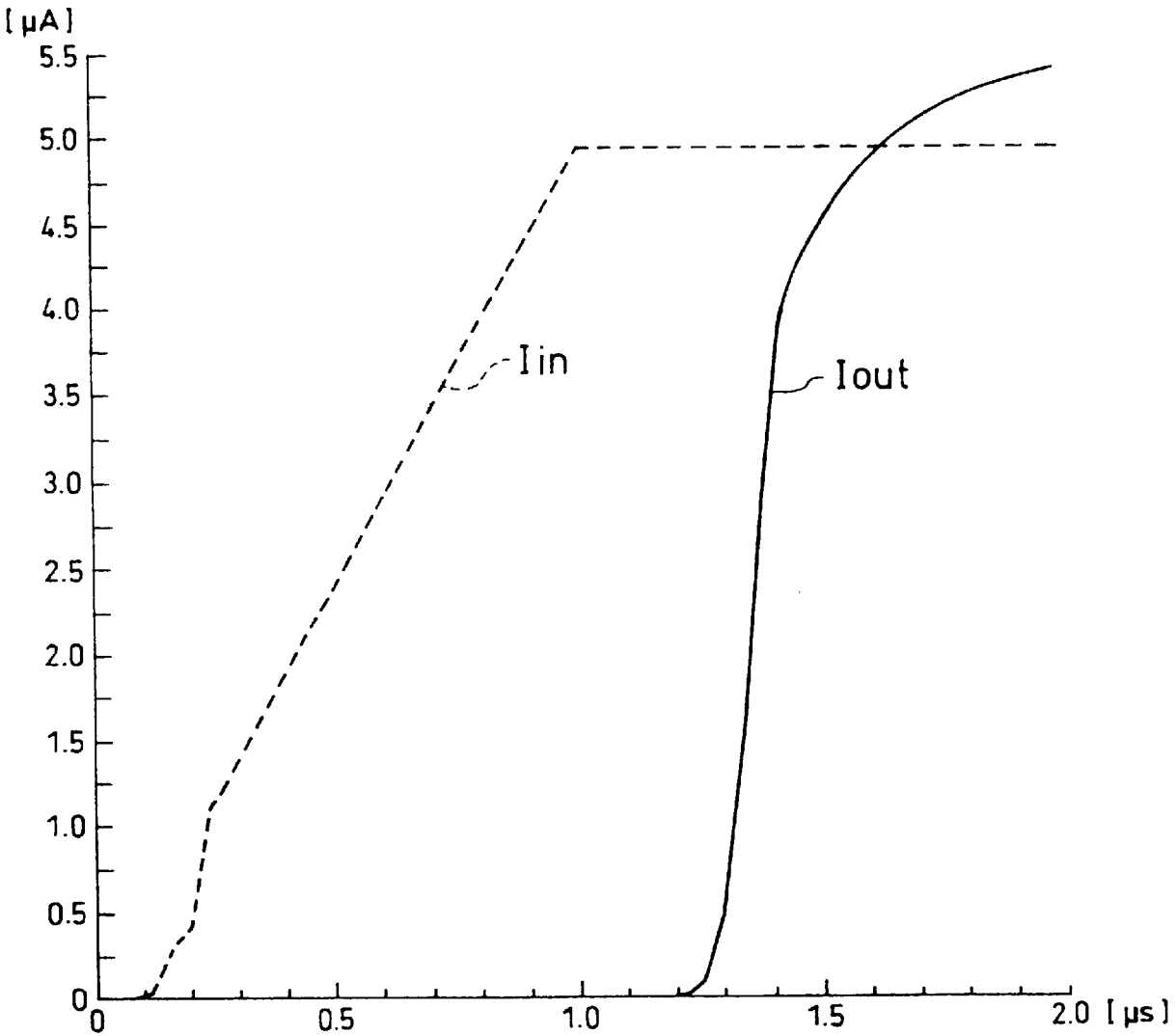
FIG. 10, representing the operation of the preceding current mirror circuit section, is a graph of rise properties of the input and output currents.

For example, with the arrangement of the conventional current mirror circuit section 104*a* shown in FIG. 9, provided that the gate parasitic capacity of the two MOS transistors P111 and P112 is set to 5 [pF] and also that the input current $I_{in}$ is set to 5 [$\mu$A], as shown in FIG. 10, the change in the output current $I_{out}$ lags that of the input current $I_{in}$ by more than about 1 $\mu$s. By contrast, the lag time of the current mirror circuit section 4 of the present embodiment is shorted to about 200 [ns] as shown in FIG. 3, under the same conditions that the gate parasitic capacity of the two MOS transistors P1 and P2 is set to 5 [pF], and the input current $I_{in}$ is set to 5 [$\mu$A].

Further, regardless of the source voltage of the MOS transistor P3, the gate-drain voltage of the NPN transistor N5 is maintained at a predetermined value (the base-emitter voltage, $V_{BE}$, of the NPN transistor N5). Therefore, even if the resistors R1 and R2 are connected to the sources of the MOS transistors P1 and P2 to reduce errors in the output current $I_{out}$ caused by offsets of the MOS transistors P1 to P4, the NPN transistor N5 still enables the two MOS transistors P3 and P4 to operate in the saturation regions thereof regardless of variations in the input current $I_{in}$. As a result, when the resistors R1 and R2 are interposed, circuit arrangement can be relatively facilitated compared to a conventional technology (the current mirror circuit section 104*a* shown in FIG. 9) wherein the gate voltage needs to be controlled according to the input current $I_{in}$ through the bias voltage power source 106.

Meanwhile, compared to the arrangement shown in FIG. 9 where no resistors R1 and R2 are interposed, and an improvement in the precision of the output current $I_{out}$ is attempted only by means of an increase in the gate lengths of the two MOS transistors P111 and P112, the current mirror circuit section 4 of the present embodiment can greatly improve the precision of the output current $I_{out}$ by means of the interposition of the resistors R1 and R2. For example, FIG. 10 shows that the conventional current mirror circuit section 104*a* produces about 10% errors in the output current $I_{out}$, while FIG. 3 shows that the current mirror circuit section 4 of the present embodiment produces reduces errors of 1% or less.

Figure 4:
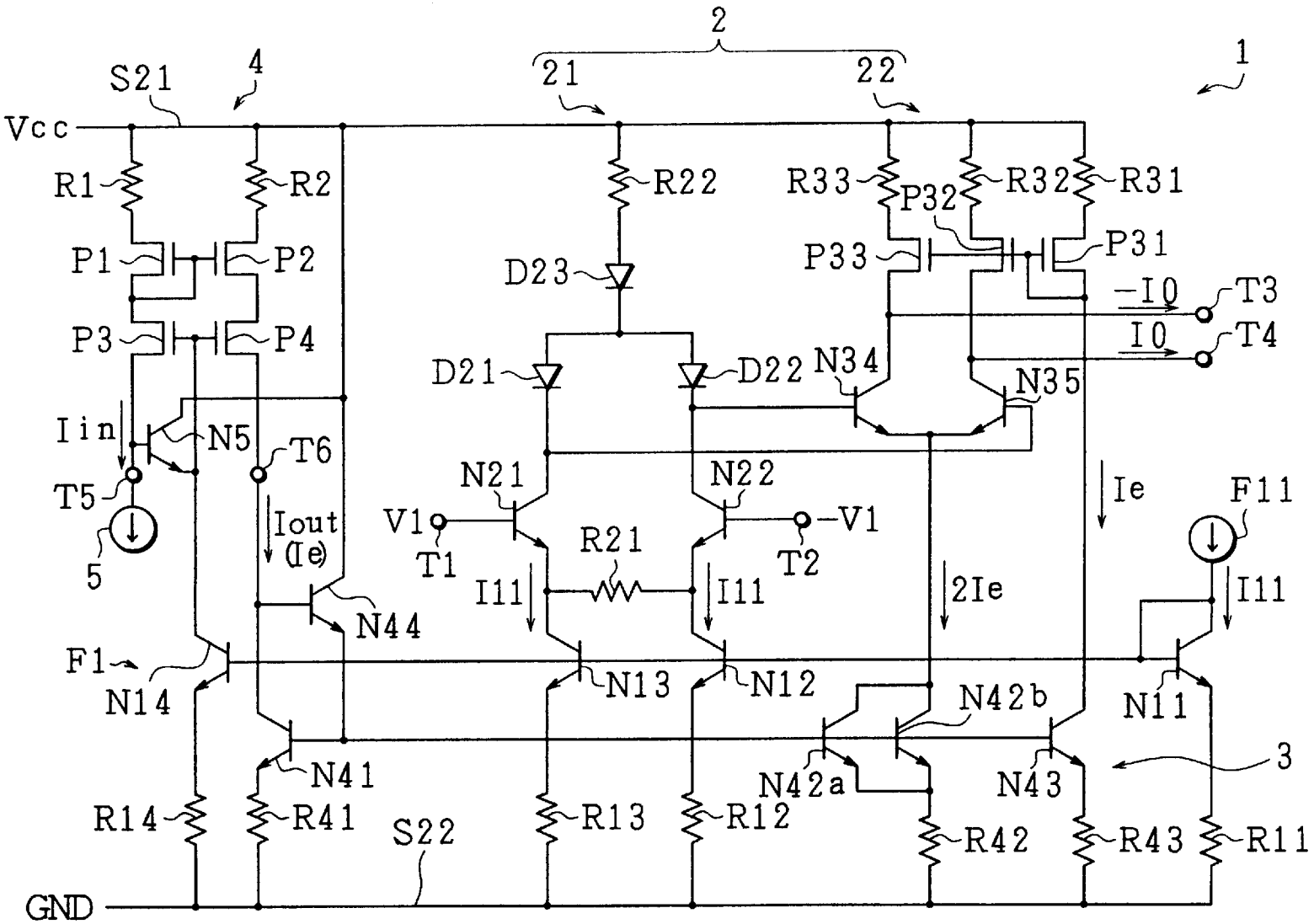
FIG. 4 is a circuit diagram showing, as an example, an arrangement of the aforementioned mutual conductance amplifier.

Now, referring to the circuit diagram shown in FIG. 4, the following description will discuss in more detail the current mirror circuit section 4 shown in FIG. 1 being applied to the mutual conductance amplifier 1 shown in FIG. 2.

In FIG. 4, the constant current source F1 for the current mirror circuit section 4 shown in FIG. 1 is realized using the current mirror circuit composed of NPN transistors N11 to N14. The NPN transistors N11 to N14 are connected to each other via the bases thereof. The base of the NPN transistor N11 is connected to the collector thereof as well as to the constant current source F11. The emitters of the NPN transistors N11 to N14 are grounded via respective resistors R11 to R14. Further, the collector of the NPN transistor N14 is connected to the emitter of the NPN transistor N5, to which a current is supplied, as well as to the gates of the MOS transistors P3 and P4, and can be fed with a current (I11) of an equal value to the current I11 supplied from the constant current source F11. Note that the collectors of the other NPN transistors N12 and N13 will be described later in detail.

Meanwhile, the amplifier section 2 shown in FIG. 2 is provided with a differential input section 21 for receiving input voltages V1 and −V1 that are a.c. voltage signals, and a differential output section 22 for producing currents I0 and −I0 that are a.c. current signals for output. The differential input section 21 includes NPN transistors N21 and N22 of which the emitters are connected to each other via a resistor R21. The base of the NPN transistor N21 is connected to a voltage input terminal T1, and is fed with one of the input voltages, V1. The other input voltage −V1 is applied to the base of the NPN transistor N22, similarly, via the voltage input terminal T2. In addition, the emitters of the NPN transistors N21 and N22 are connected to the aforementioned collectors of the NPN transistors N12 and N13, and fed with a current of an equal value to the current I11 supplied from the constant current source F11.

Meanwhile, the collectors of the two NPN transistors N21 and N22 are connected to respective diodes D21 and D22, and the connecting point of the NPN transistor N21 to the diode D21 is connected to a later-mentioned NPN transistor N35 of a differential output section 22. Similarly, the connecting point of the NPN transistor N22 to the diode D22 is connected to a later-mentioned NPN transistor N34 of a differential output section 22. In addition, the anodes of the two diodes D21 and D22 are connected to each other, and further connected via the diode D23 and the resistor R22 to the power source line S21 that is maintained at the power source voltage $V_{cc}$. Note that the two diodes D21 and D22 are realized by NPN transistors of which the collector is connected to the base.

Meanwhile, the differential output section 22 is provided with Pch MOS transistors P31, P32, and P33 constituting a current mirror circuit, of which the gates are connected to each other, as well as with NPN transistors N34 and N35 constituting a differential pair, of which the emitters are connected to each other.

More specifically, the drain of the MOS transistor P31 is connected to the gate thereof, and fed with a gm control-use current $I_e$ from a later-mentioned NPN transistor N43 of the gm control section 3. In addition, the drain of the MOS transistor P32 is connected to the collector of the NPN transistor N35, as well as to the current output terminal T4. Similarly, the drain of the MOS transistor P33 is connected to the collector of the NPN transistor N34, as well as to the current output terminal T3. Note that the sources of the MOS transistors P31 to P33 are connected via respective resistors R31 to R33 to the power source line S21. Further, the common emitter for the NPN transistors N34 and N35 is fed with a current of a value twice the gm control-use current $I_e$ from the later-mentioned gm control section 3.

Here, in FIG. 4, the gm control section 3 shown in FIG. 2 is realized as a current mirror circuit composed of NPN transistors N41 to N43. In other words, the NPN transistor N41, N42*a*, N42*b*, and N43, are connected to each other via the bases thereof. In addition, the emitters of the NPN transistors N41 and N43 are connected via respective resistors R41 and resistor R43 to a power source line S22 that is maintained at ground level. The emitters of the NPN transistor N42*a* and N42*b* are connected to each other, and then grounded via a resistor R42.

Further, the collector of the NPN transistor N41 is fed with the output current $I_{out}$ as the gm control-use current $I_e$ from the MOS transistor P4 of the current mirror circuit section 4. In addition, the collector of the NPN transistor N41 is connected to the base thereof via the NPN transistor N44.

More specifically, the collector of the NPN transistor N41 is connected to the base of the NPN transistor N44, and the emitter of the NPN transistor N44 is connected to the base of the NPN transistor N41. Note that the collector of the NPN transistor N44 is fed with the power source voltage $V_{cc}$.

Meanwhile, the collectors of the NPN transistors N42*a* and N42*b* are connected to the emitters of the NPN transistors N34 and N35 that constitute a differential pair for the differential output section 22. The collector of the NPN transistor N43 is connected to the drain of the MOS transistor P31 that serves as a bias-use current source for the differential output section 22. Thus, the gm control section 3 supplies a current of a value twice the gm control-use current $I_e$ to the differential pair (NPN transistors N34 and N35) of the differential output section 22, and a current of the same value as the gm control-use current $I_e$ to the bias-use current source (the MOS transistor P31).

With the arrangement, in the differential input section 21, since the currents supplied from the NPN transistors N12 and N13 are of the same value (I11), the current passing through the diode D21 and the NPN transistor N21 and the current passing through the diode D22 and the NPN transistor N22 are expressed as I11+ΔI and I11−ΔI respectively, where ΔI is the current passing through the resistor R21. Therefore, the voltage drop (base-emitter voltage), V21, across the diode D21 is given by Equation (1):

$$V21=(k\cdot T/q)\times\ln[(I11+\Delta I)/I_s] \quad (1)$$

and the voltage drop, V22, across the diode D22 is given by Equation (2):

$$V22=(k\cdot T/q)\times\ln[(I11-\Delta I)/I_s] \quad (2)$$

where k, T, and q are Boltzman constant, absolute temperature, and electric charge respectively, and $I_s$ is reverse direction saturated current.

Therefore, the base potential difference, $\Delta V_{BE}$, of the NPN transistors N34 and N35 that constitutes a differential pair for the differential output section 22 becomes equal to the difference between the two voltage drops V21 and V22, and is given by Equation (3):

$$V_{BE}=(k\cdot T/q)\times\ln[(I11+\Delta I)/(I11-\Delta I)] \quad (3)$$

Meanwhile, the MOS transistors P33 and P32 supply currents $I_e$ of an equal value. The current output terminal T3 is fed with a current of –I0, while the current output terminal T4 is fed with a current of I0. In addition, the sum of the currents passing through the two NPN transistors N34 and N35 equals $2I_e$. Therefore, the current passing through the NPN transistor N34 and the current passing through the NPN transistor N35 equal $I_e$+I0 and $I_e$–I0 respectively, and the base potential difference, $\Delta V_{BE}$, of the two NPN transistors N34 and N35 is given by Equation (4):

$$V_{BE}=(k\cdot T/q)\times\ln[(I_e+I0)/(I_e-I0)] \quad (4)$$

Here, Equation (5) is derived from Equations (3) and (4):

$$(I11+\Delta I)/(I11-\Delta I)=(I_e+I0)/(I_e-I0) \quad (5)$$

By rearranging Equation (5), Equation (6) is derived:

$$I0=(I_e/I11)\times\Delta I \quad (6)$$

Meanwhile, assuming with the differential input section 21 that the resistor R21 has a resistance of Re, the current $\Delta I$ passing through resistor R21 is given by Equation (7):

$$\Delta I=[V1-(-V1)]/Re=2V1/Re \quad (7)$$

As a result, the mutual conductance gm of the mutual conductance amplifier 1 is given by Equation (8):

$$gm=I0/V1=(I_e/I11)\times(2/Re) \quad (8)$$

As clearly understood from Equation (8), the mutual conductance gm can be readily controlled through the currents $I_e$ and I11 to desired values.

Here, the current I11 is fed from the constant current source F11, and supplied via the current mirror circuit composed of the NPN transistors N11 to N14 and the resistors R11 to R14. Meanwhile, the current $I_e$ is fed from the control-use current source 5, and supplied via the current mirror circuit section 4 and the gm control section 3 of the present embodiment. Therefore, if the output current I11 of the constant current source F11 is maintained at a constant value, the mutual conductance gm of the mutual conductance amplifier 1 can be controlled by controlling the amount of current output from the control-use current source 5.

Figure 8:
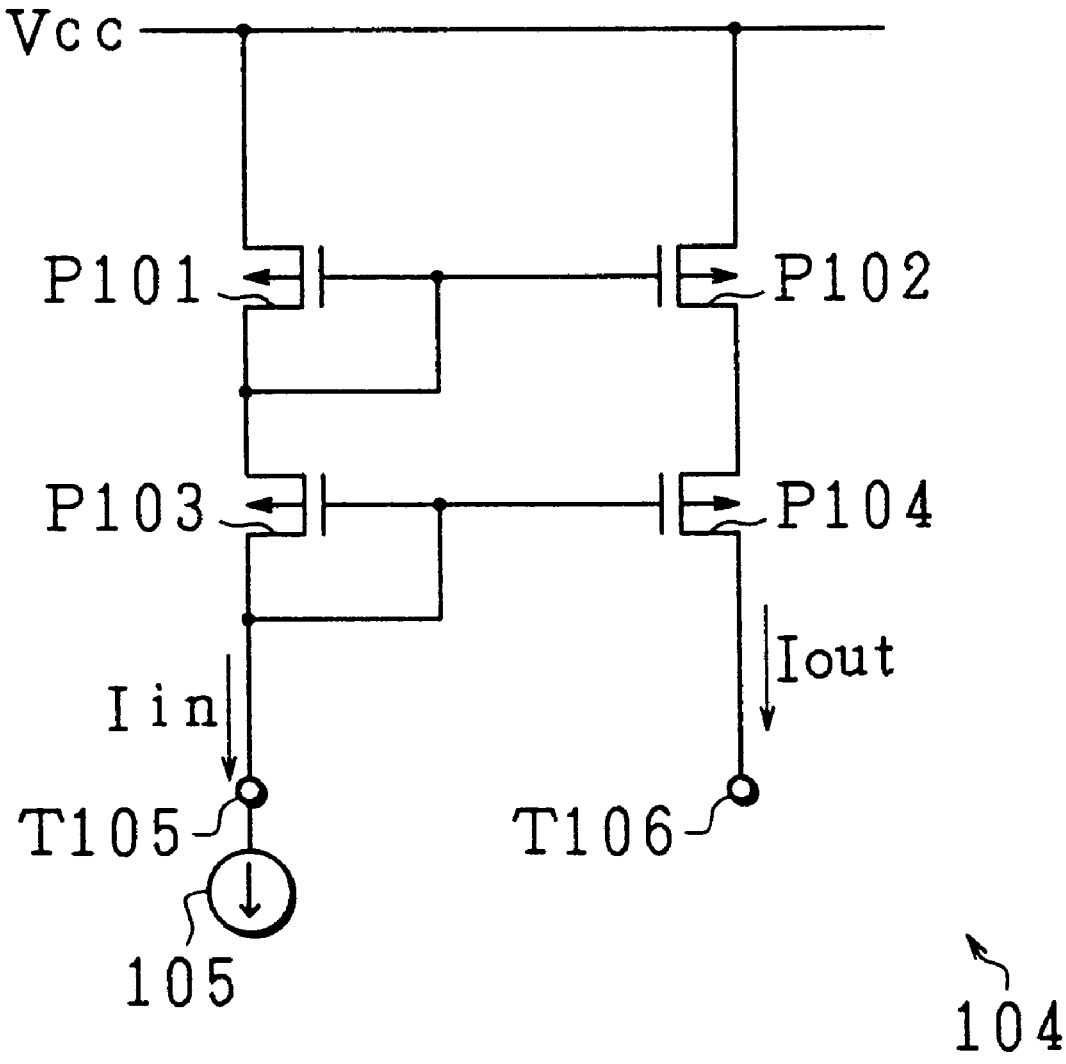
FIG. 8, in reference to a conventional technology, is a circuit diagram showing an arrangement of a major part of a current mirror circuit section FIG. 9, in reference to another conventional technology, is a circuit diagram showing a current mirror circuit section to which a bias voltage power source is provided.

As mentioned above, the current mirror circuit section 4 is endowed with an input voltage range (dynamic range) that is wider than that of the conventional current mirror circuit section 104 shown in FIG. 8 by a value equivalent to the base-emitter voltage, $V_{BE}$, of the NPN transistor N5. In addition, compared to the conventional current mirror circuit section 104*a* shown in FIG. 9, even if the control-use current source 5 is in an off state, since the base current (I11/$h_{FE}$) of the NPN transistor N5 is supplied to the MOS transistors P1 and P3, the current mirror circuit section 4 of the present embodiment needs a relatively short rise-time when changed from an on state to an off state. Further, since the resistors R1 and R2 can be interposed without a complex circuit arrangement, errors in the output current $I_{out}$ (the gm control-use current $I_e$) that are caused by offset of the MOS transistors P1 and P2 can be restrained.

As a result, even when the value of the current ($I_e$) supplied from the control-use current source 5 is varied across a wide voltage range, the current mirror circuit section 4 is still capable of controlling the gm control-use current $I_e$ very quickly and highly precisely. As a result, the mutual conductance amplifier 1, although offering a wide dynamic range for the control-use current source 5, is capable of controlling the mutual conductance gm very quickly and highly precisely.

Incidentally, the current mirror circuit section 4 shown in FIG. 1 is endowed with an input voltage range that is wider than that of the conventional current mirror circuit section 104 by a value equivalent to the base-emitter voltage, $V_{BE}$, of the NPN transistor N5. However, if an even wider input voltage range needs to be imparted, a current mirror circuit section 4*a* shown in FIG. 5, for example, may be used in place of the current mirror circuit section 4 shown in FIG. 1.

The current mirror circuit section 4*a* is different from the current mirror circuit section 4 shown in FIG. 1 in that an NPN transistor (second bipolar transistor) N6, which is similar to the NPN transistor N5, is interposed between the gate and the drain, instead of directly connecting the gate and the drain of the MOS transistor P1.

More specifically, the base of the NPN transistor N6 is connected to the drain of the MOS transistor P1, and the emitter thereof is connected to the gate of the MOS transistor P1 as well as to a constant current source (second bias current source) F2 that supplies a predetermined current. In addition, the collector of the NPN transistor N6 is fed with the power source voltage $V_{cc}$. Note that since the current mirror circuit section 4*a*, as well as later-mentioned other variations (4*b* and 4*c*), has substantially the same arrangement as the current mirror circuit section 4 shown in FIG. 1, members that have the same arrangement and function are indicated by the same reference numerals and description thereof is omitted.

The output current from the current mirror circuit section 4 shown in FIG. 1 fluctuates due to non-uniformity in properties of the MOS transistors P1 and P2 (non-uniformity in properties occurring during manufacture) and/or non-uniformity in properties of the MOS transistors P3 and P4 (non-uniformity in properties occurring during manufacture). To restrain these fluctuations, the gate lengths of the MOS transistors P1 and P2 and/or the gate lengths of the MOS transistors P3 and P4 are set to a large value in the current mirror circuit section 4, and thereby adverse effects caused by offset can be reduced. However, when the gate lengths are set to a large value, the gate parasitic capacity increases accordingly, and the current mirror circuit section 4 takes a longer time to start the flowing of an output current when an input current is applied thereto.

Figure 5:
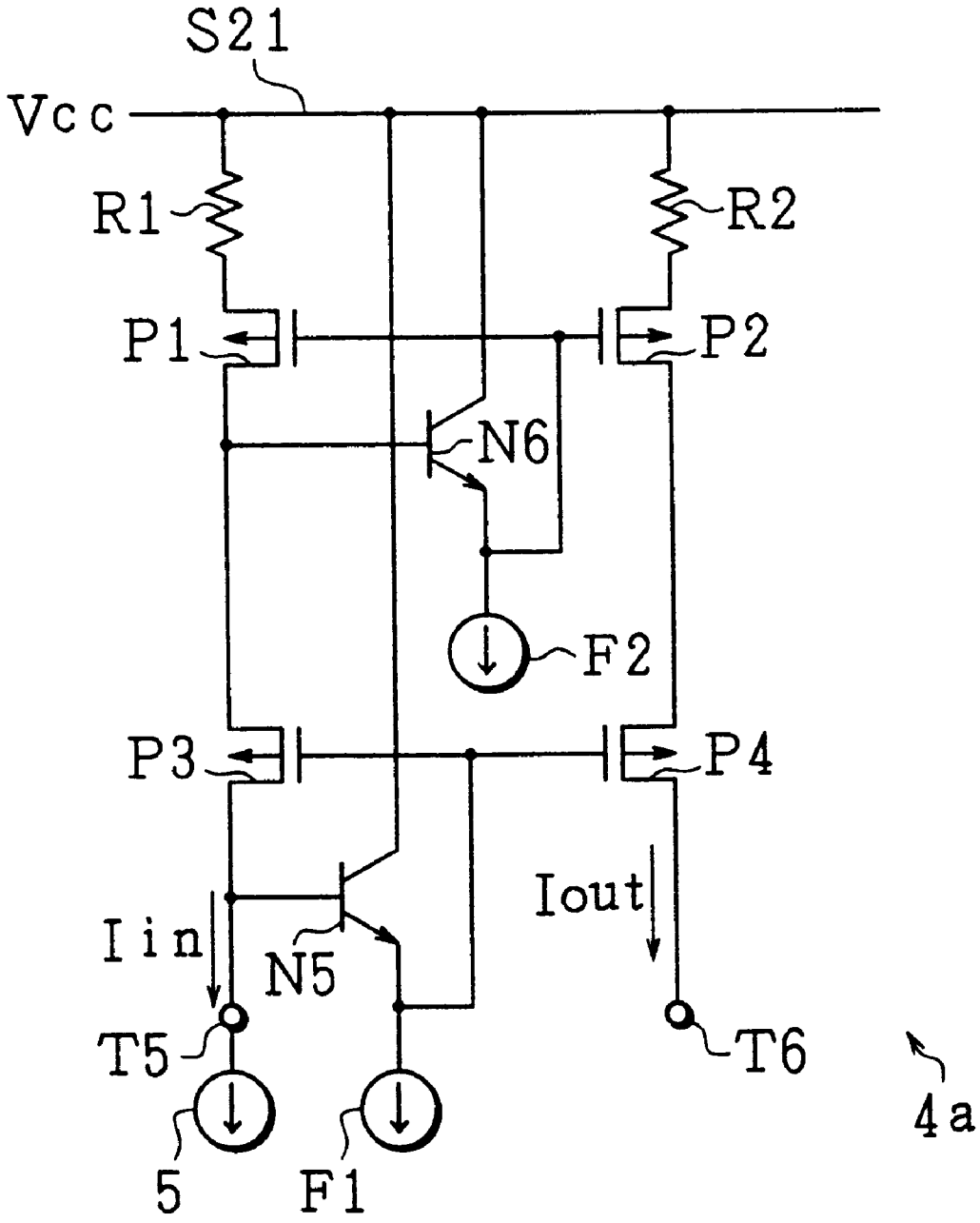
FIG. 5 is a circuit diagram showing a variation of the aforementioned current mirror circuit section.

Accordingly, if the current mirror circuit section 4*a* having the arrangement shown in FIG. 5 is used, electric charges stored in the gate parasitic capacity of the MOS transistors P1 and P2 are always discharged via the constant current source F2, as well as electric charges stored in the gate parasitic capacity of the MOS transistors P3 and P4 are always discharged via the constant current source F1. Thus, even if the gate lengths are set to a large value, there is no need to let the accumulated electric charge flow out via the gates of the MOS transistors P1 and P2 and the gates of the MOS transistors P3 and P4 when the input current is changed from an on state to an off state with the current mirror circuit section 4*a*. This ensures a shorter rise-time for the current mirror circuit section 4*a*. Therefore, it is ensured that the resultant current mirror circuit section 4*a* is highly precise in output current and has a short rise-time, even if there exists non-uniformity in properties occurring during manufacture as mentioned earlier.

Also with the arrangement, the provision of the NPN transistor N5 (first input dynamic range widening means) renders the MOS transistor P3 to have a higher drain potential than a gate potential by a value equivalent to the base-emitter voltage, $V_{BE}$, of the NPN transistor N5, thereby expanding the input dynamic range of the MOS transistor P3 by a value equivalent to the voltage $V_{BE}$. Similarly, the MOS transistor P1 is rendered to have a higher drain potential than a gate potential by a value equivalent to the base-emitter voltage, $V_{BE}$, of the NPN transistor N6 (second input dynamic range widening means), thereby expanding the input dynamic range of the MOS transistor P1 by a value equivalent to the voltage $V_{BE}$. In this manner, the drain voltage of the MOS transistor P1 is higher than the gate voltage thereof by a value equivalent to the base-emitter voltage, $V_{BE}$, of the NPN transistor N6. As a result, the current mirror circuit section 4*a* is endowed with an input voltage range (input dynamic range) that is wider than that of the current mirror circuit section 4 shown in FIG. 1 by a value equivalent to the base-emitter voltage, $V_{BE}$, of the NPN transistor N6.

Figure 6:
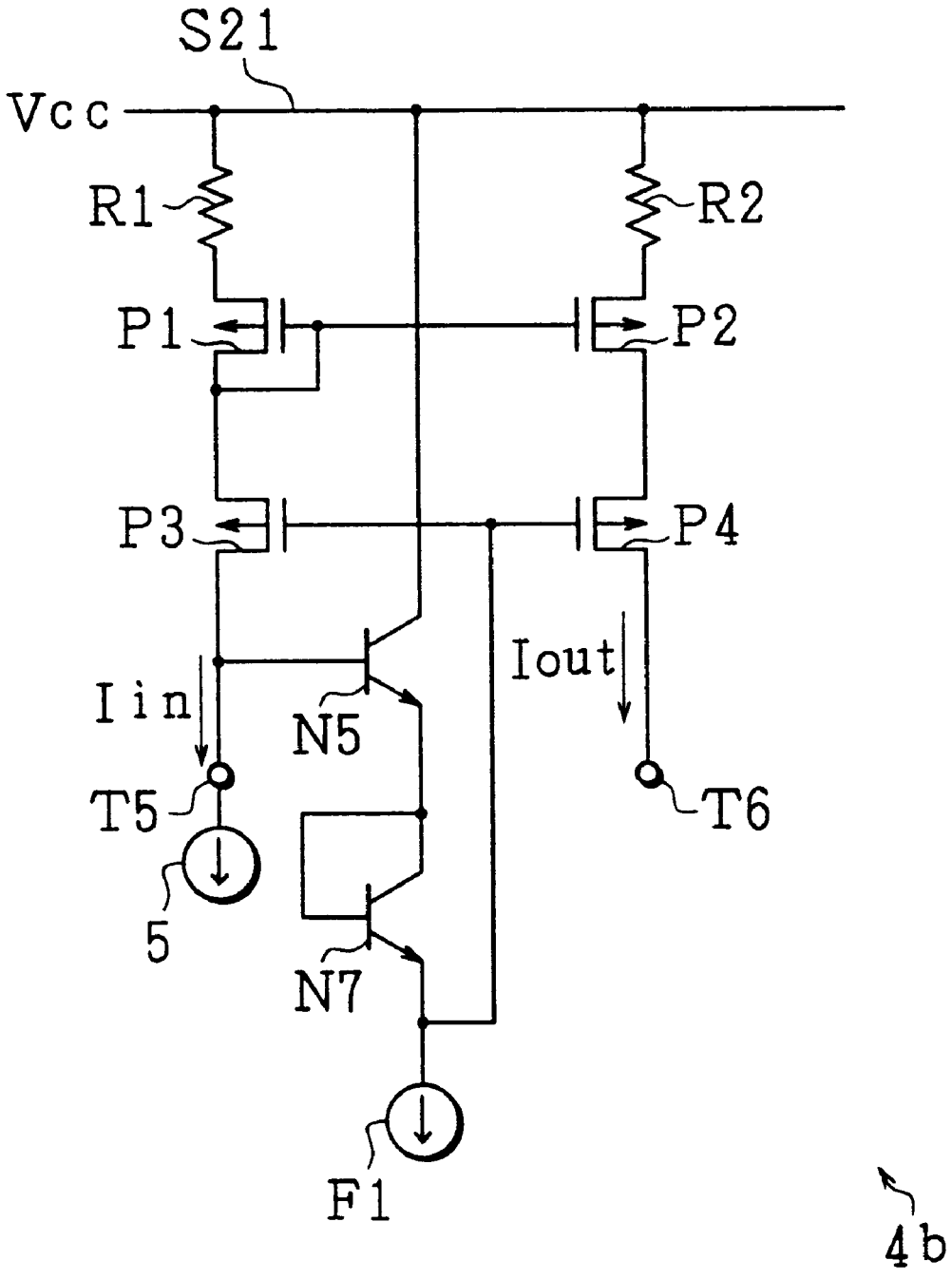
FIG. 6 is a circuit diagram showing another variation of the aforementioned current mirror circuit section.

In addition, when a wide input voltage range is required, a current mirror circuit section 4*b* shown in FIG. 6 may be used in place of the current mirror circuit section 4 shown in FIG. 1. The current mirror circuit section 4*b*, besides having the arrangement shown in FIG. 1, includes a diode N7 interposed between the emitter of the NPN transistor N5 and the constant current source F1. Note that the diode N7 is realized by using an NPN transistor of which the collector is connected to the base, the collector and the base are connected to the emitter of the NPN transistor N5, and the emitter is connected to the constant current source F1 and to the gates of the MOS transistors P3 and P4.

With the arrangement, the drain voltage of the MOS transistor P3 is higher than in the case of FIG. 1 by a value equivalent to the forward drop voltage (the base-emitter voltage $V_{BE}$) of the diode N7. As a result, compared to the input voltage range of the current mirror circuit section 4 shown in FIG. 1, the input voltage range of the current mirror circuit section 4*b* is further expanded by a value equivalent to the base-emitter voltage, $V_{BE}$, of the diode N7.

Note that the above description described an example where the current mirror circuit section 4 includes the arrangement shown in FIG. 1, and also includes the additional diode N7 being interposed between the emitter of the NPN transistor N5 and the constant current source F1. However, this is by no means intended to limit the scope of the present invention. An alternative arrangement to similarly expand the input voltage range may contain, in addition to the arrangement shown in FIG. 5, a first diode being interposed between the emitter of the NPN transistor N5 and the constant current source F1, which is connected in a similar manner as in FIG. 6, and a second diode being interposed between the emitter of the NPN transistor N6 and the constant current source F2, which is connected in a similar manner as in FIG. 6. In this case, the input voltage range is expanded by a value equivalent to the sum of the base-emitter voltages, $V_{BE}$, of the first and second diodes, and therefore an even wider input voltage range (input dynamic range) can be imparted to the current mirror circuit section.

Figure 7:
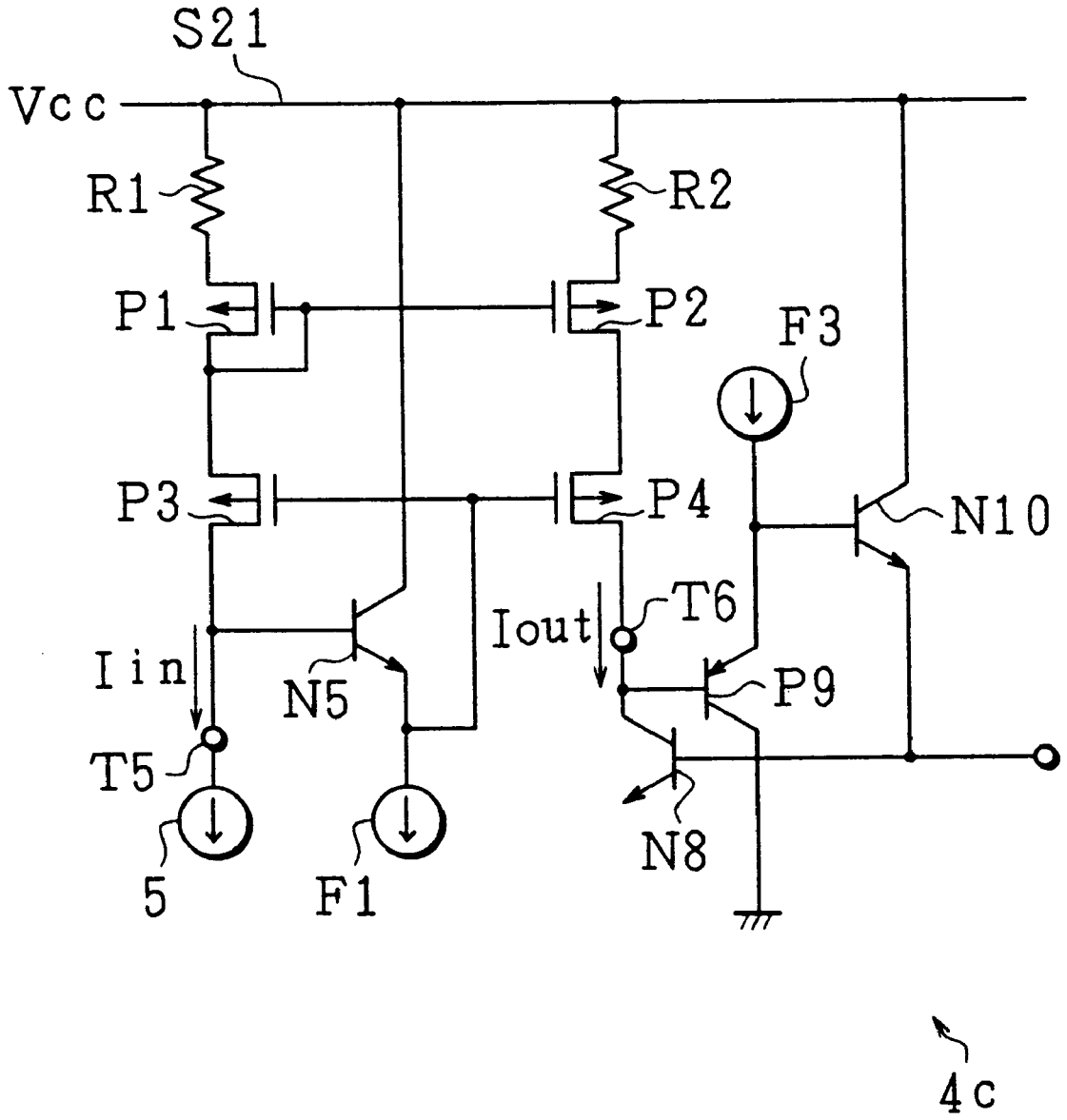
FIG. 7 is a circuit diagram showing a further variation of the aforementioned current mirror circuit section.

Meanwhile, if the current mirror circuit section is required to have a wider output voltage range, a current mirror circuit section 4*c* shown in FIG. 7 may be used in place of the current mirror circuit section 4 shown in FIG. 1. The current mirror circuit section 4*c* contains, in addition to the arrangement of the current mirror circuit section 4, an NPN transistor N8 (first output transistor) of which the collector is connected to the drain of the MOS transistor P4; a PNP transistor P9 (second output transistor) of which the base is connected to the connecting point of the NPN transistor N8 to the MOS transistor P4, the emitter is connected to the bias-use constant current source F3, and the collector is grounded; and an NPN transistor N10 (third output transistor) of which the base is connected to the connecting point of the PNP transistor P9 to the constant current source F3, the emitter is connected to the base of the NPN transistor N8, and the collector is connected to the power source line S21.

Note that if the current mirror circuit section 4*c* is used with the mutual conductance amplifier 1*c*, the NPN transistors N8 and N10 are used in place of the NPN transistors N41 and N44 shown in FIG. 4, and the PNP transistor P9 is further provided.

With the arrangement, the PNP transistor P9 is interposed between the collector of the NPN transistor N8 and the base of the NPN transistor N10. Therefore, the base potential of the NPN transistor N8 is higher than in the arrangement shown in FIG. 4 where the collector of the NPN transistor N8 is directly connected to the base of the NPN transistor N10 by a value equivalent to the base-emitter voltage, $V_{BE}$, of the PNP transistor P9. Consequently, the difference between the base potential of the NPN transistor N8 and the ground level (GND) becomes greater, enabling the current mirror circuit section 4*c* to have an expanded output voltage range (output dynamic range).

Use of the current mirror circuit section 4*c* in the arrangement shown in FIG. 4 would increase the difference between the base potential of the NPN transistor N8 and the ground level, therefore enabling the voltage ranges of the resistors R41 to R43 to be set wider. As a result, the resistors R41 to R43 can have high resistances, and errors in output current $I_{out}$ (gm control-use current $I_e$) caused by difference between resistances can be reduced.

Note that the foregoing described the current mirror circuit section 4*c* shown in FIG. 7 (the current mirror circuit section 4, plus an arrangement to expand an output voltage range (including the NPN transistor N8, the PNP transistor P9, the NPN transistor N10, and the constant current source F3)) as an example to expand the output voltage range (output dynamic range) of the current mirror circuit. However, this is by no means intended to limit the scope of the present invention. Alternatively, the preceding arrangement to expand an output voltage range may be contained in either of the current mirror circuit sections 4*a* and 4*b* shown in FIG. 5 and FIG. 6 respectively.

In addition, in the present embodiment so far, Pch MOS transistors were used as the MOS transistors P1 to P4 as an example. Needless to say, Nch MOS transistors could be used with the same advantages. In such a case, the polarity of the bipolar transistor is reversed, e.g., the NPN transistor N5 is replaced for a PNP transistor, the power source line S21 is kept at ground level, and the power source voltage $V_{cc}$ is applied to the power source line S22. Thus, a resultant current mirror circuit is highly precise in output current, and short in rise-time when changed from an on state to an off state, while maintaining a wide input voltage range.

In addition, the above description described an example where the current mirror circuit section 4 (4*a* to 4*c*) transmits the gm control-use current $I_e$ of the mutual conductance amplifier 1 (1*a* to 1*c*). However, this is by no means intended to limit the scope of the present invention. Alternatively, if the current mirror circuit section 4 (4*a* to 4*c*) of the present embodiment is used, current can be transmitted quickly and highly precisely while maintaining a wide input voltage range, opening up opportunities for wider range of applications. However, as to the mutual conductance amplifier 1 (1*a* to 1*c*), the gm control-use current $I_e$ needs to be controlled highly quickly and precisely in order to control the mutual conductance gm highly quickly and precisely. Therefore, the current mirror circuit section 4 (4*a* to 4*c*) would be especially effective when used with the mutual conductance amplifier 1 (1*a* to 1*c*).

As mentioned above, a first current mirror circuit in accordance with the present invention includes:

- a first MOS transistor having a source being connected to a first power source line that is maintained at a predetermined potential;
- a second MOS transistor having a gate being connected to a gate and a drain of the first MOS transistor, and having a source being connected to the first power source line;
- a third MOS transistor having a source being connected to the drain of the first MOS transistor; and
- a fourth MOS transistor having a gate being connected to a gate of the third MOS transistor, and having a source being connected to a drain of the second MOS transistor, the first current mirror circuit further including:

- a first bipolar transistor having a polarity opposite to that of the third and fourth MOS transistors, having a base being connected to a drain of the third MOS transistor, and having an emitter being connected to the gates of the third and fourth MOS transistors; and
- a first bias current source connected to the emitter of the first bipolar transistor.

Note that the first bipolar transistor and a later-mentioned second bipolar transistor are realized by using NPN transistors if the first through fourth MOS transistors are Pch MOS transistors, and are realized by using PNP transistors if the first through fourth MOS transistors are Nch MOS transistors.

With the arrangement, the drain potential of the third MOS transistor is relatively high compared to the gate potentials of the third and fourth MOS transistors due to the base-emitter voltage of the first bipolar transistor. Thus, compared to a conventional technology wherein no first bipolar transistor is provided, and the drain and the gate of the third MOS transistor are directly connected, the first through fourth MOS transistors are relatively able to continue to operate normally even with an increased input voltage provided that the increase is equal to or less than the base-emitter voltage of the first bipolar transistor. As a result, the input voltage range (input dynamic range) of the current mirror circuit can be expanded by a value equivalent to the base-emitter voltage.

Further, even if there is no current input to the drain of the third MOS transistor, a predetermined current passes through the first and third MOS transistors owing to the base current of the first bipolar transistor. Therefore, even if the input current is in an off state, electric charge always flows out via the gates of the first and second MOS transistors. As a result, even when the gate lengths of the first and second MOS transistor are set to a large value in order to restrain fluctuations in output current caused by non-uniformity occurring during manufacture, there is no need to let electric charge flow out via the gates of the first and second MOS transistor when the input current is changed to an on state. This shortens the rise-time of the current mirror circuit. Therefore, even if non-uniformity occurs during manufacture, a current mirror circuit can be realized with high output current precision and a short rise-time.

Further, a second current mirror circuit in accordance with the present invention, in addition to the arrangement of the first current mirror circuit, preferably includes a resistor being interposed between the first MOS transistor and the first power source line and another resistor being interposed between the second MOS transistor and the first power source line.

With the arrangement, if the first and second MOS transistors do not have equal threshold voltages due to non-uniformity during manufacture, and the currents passing through the first and second MOS transistors are not equal to each other, the voltage drop across the resistor connected to one of the first and second MOS transistors which is passing a higher current than the other grows higher, thereby reducing the current passing through that MOS transistor. As a result, the discrepancy in input current and output current caused by offset can be reduced, further improving the precision of output current.

Note that the two resistors enables the source potentials of the first and second MOS transistor to vary depending on input current. Nevertheless, unlike an arrangement where operation needs to be changed depending on whether or not there is an input current resistor included, and if included, depending on the resistance thereof, such as a conventional arrangement where a bias voltage power source is provided, the first bipolar transistor renders the drain potential of the third MOS transistor higher than the gate potential thereof. Therefore, without having to change the operation depending on the magnitude of input current, the presence of an input current resistor, or the resistance, the first bipolar transistor enables the first through fourth MOS transistors to continue to operate in the saturation regions thereof. As a result, the arrangement of the current mirror circuit is rendered less complex.

Further, a third current mirror circuit in accordance with the present invention includes:

- a first MOS transistor having a source being connected to a first power source line that is maintained at a predetermined potential;
- a second MOS transistor having a gate being connected to a gate of the first MOS transistor, and having a source being connected to the first power source line;
- a third MOS transistor having a source being connected to a drain of the first MOS transistor;
- a fourth MOS transistor having a gate being connected to a gate of the third MOS transistor, and having a source being connected to a drain of the second MOS transistor;
- a first bipolar transistor having a polarity opposite to that of the third and fourth MOS transistors, having a base being connected to a drain of the third MOS transistor, having an emitter being connected to the gates of the third and fourth MOS transistors, and having a collector being connected to the first power source line;
- a second bipolar transistor having a polarity opposite to that of the first and second MOS transistors, having a base being connected to the drain of the first MOS transistor, having an emitter being connected to the gates of the first and second MOS transistors, and having a collector being connected to the first power source line;

a first bias current source connected to the emitter of the first bipolar transistor; and a second bias current source connected to the emitter of the second bipolar transistor.

With the arrangement, electric charges stored in the gate parasitic capacity of the first and second MOS transistors are always discharged via the second bias current source, and electric charges stored in the gate parasitic capacity of the third and fourth MOS transistors are always discharged via the first bias current source. Thus, even if the gate lengths are set to a large value, since there is no need to let the accumulated electric charge flow out via the gates of the first and second MOS transistors and the gates of the third and fourth MOS transistors when the input current is changed from an on state to an off state in the current mirror circuit, it is ensured that the rise-time of the current mirror circuit is shortened. Therefore, even if there occurs non-uniformity in properties during manufacture, it is ensured that a current mirror circuit is realized that is precise in output current and short in rise-time.

Further with the arrangement, the first bipolar transistor renders the third MOS transistor to have a higher gate potential than a drain potential by a value equivalent to the base-emitter voltage of the first bipolar transistor, thereby expanding the input dynamic range by that amount. Similarly, the first MOS transistor is rendered to have a higher gate potential than a drain potential by a value equivalent to the base-emitter voltage of the second bipolar transistor, thereby expanding the input dynamic range by that amount. In this manner, the drain voltage of the first MOS transistor is higher than the gate voltage thereof by a value equivalent to the base-emitter voltage of the second bipolar transistor.

As a result, the drain potential of the first MOS transistor is rendered higher than the gate potentials of the first and second MOS transistors by a value equivalent to the base-emitter voltage of the second bipolar transistor. Thus, compared to the first current mirror circuit, the first through fourth MOS transistors are relatively able to continue to operate normally even with an increased input voltage provided that the increase is equal to or less than the base-emitter voltage of the second bipolar transistor. As a result, the input voltage range of the current mirror circuit can be further expanded by that amount equivalent to the base-emitter voltage.

In addition, a fourth current mirror circuit in accordance with the present invention is preferably includes a diode between the connecting point of the gates of the third and fourth MOS transistors to the first bias current source and the emitter of the first bipolar transistor. Note that the diode is realized by using a bipolar transistor of which the base and the collector are connected to each other, for example.

With the arrangement, the emitter potential of the first bipolar transistor decreases by a value equivalent to the forward drop voltage of the diode. Therefore, the drain voltage of the third MOS transistor is higher than the gate voltage of the third MOS transistor by the sum of the base-emitter voltage of the first bipolar transistor and the forward drop voltage of the diode. As a result, compared to the first current mirror circuit, the input voltage range of the current mirror circuit can be further expanded by a value equivalent to the forward drop voltage of the diode.

Meanwhile, a fifth current mirror circuit in accordance with the present invention is characterized in that it further includes:

a first output transistor of a bipolar type having a collector being connected to a drain of the aforementioned fourth MOS transistor;

a second output transistor of a bipolar type having a polarity opposite to that of the first output transistor, having a base being connected to the collector of the first output transistor, and having an emitter given a bias by a predetermined current; and a third output transistor of a bipolar type having the same polarity as that of the first output transistor, having a base being connected to the emitter of the second output transistor, and having an emitter being connected to a base of the first output transistor. Note that the second output transistor is a PNP transistor if the first and third output transistors are NPN transistors, and also that the second output transistor is an NPN transistor if the first and third output transistors are PNP transistors. In addition, the second output transistor is given a bias by a predetermined bias current source, for example.

With the arrangement, a biased second output transistor is interposed between the collector of the first output transistor and the base of the third output transistor. Therefore, the base potential of the first output transistor is higher than in a case where the base of the third output transistor is directly connected to the collector of the first output transistor, by a value equivalent to the base-emitter voltage of the second output transistor. As a result, the operating voltage range of the first output transistor is expanded by that amount equivalent to the base-emitter voltage, thereby expanding the output voltage range (output dynamic range) of the current mirror circuit.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A current mirror circuit, comprising:

a first current mirror circuit composed of first and second MOS transistors;

a second current mirror circuit, composed of third and fourth MOS transistors, which is cascade connected to the first current mirror circuit; and input dynamic range widening means for discharging electric charges stored in a gate parasitic capacity of the first and second MOS transistors and for rendering the third MOS transistor to have a higher drain potential than a gate potential by a predetermined amount.

2. The current mirror circuit as defined in claim 1, wherein the first and second MOS transistors are each fed with a power source voltage via a resistor.

3. A current mirror circuit, comprising:

a first current mirror circuit composed of first and second MOS transistors;

a second current mirror circuit, composed of third and fourth MOS transistors, which is cascade connected to the first current mirror circuit;

first input dynamic range widening means for discharging electric charges stored in a gate parasitic capacity of the third and fourth MOS transistors and for rendering the third MOS transistor to have a higher drain potential than a gate potential by a predetermined amount; and second input dynamic range widening means for discharging electric charges stored in a gate parasitic capacity of the first and second MOS transistors and for rendering the first MOS transistor to have a higher drain potential than a gate potential by a predetermined amount.

4. The current mirror circuit as defined in claim 3, wherein the first and second MOS transistors are each fed with a power source voltage via a resistor.

5. The current mirror circuit as defined in claim 1, further comprising output dynamic range widening means for widening an output voltage range.

6. A current mirror circuit, comprising:

a first MOS transistor having a source being connected to a first power source line that is maintained at a predetermined potential;

a second MOS transistor having a gate being connected to a gate and a drain of the first MOS transistor, and having a source being connected to the first power source line;

a third MOS transistor having a source being connected to the drain of the first MOS transistor;

a fourth MOS transistor having a gate being connected to a gate of the third MOS transistor, and having a source being connected to a drain of the second MOS transistor;

a first bipolar transistor having a polarity opposite to that of the third and fourth MOS transistors, having a base being connected to a drain of the third MOS transistor, and having an emitter being connected to the gates of the third and fourth MOS transistors; and a first bias current source connected to the emitter of the first bipolar transistor.

7. The current mirror circuit as defined in claim 6, wherein a first resistor is provided between the first MOS transistor and the first power source line, and a second transistor between the second MOS transistor and the first power source line.

8. A current mirror circuit, comprising:

a first MOS transistor having a source being connected to a first power source line that is maintained at a predetermined potential;

a second MOS transistor having a gate being connected to a gate of the first MOS transistor, and having a source being connected to the first power source line;

a third MOS transistor having a source being connected to a drain of the first MOS transistor;

a fourth MOS transistor having a gate being connected to a gate of the third MOS transistor, and having a source being connected to a drain of the second MOS transistor;

a first bipolar transistor having a polarity opposite to that of the third and fourth MOS transistors, having a base being connected to a drain of the third MOS transistor, and having an emitter being connected to the gates of the third and fourth MOS transistors;

a second bipolar transistor having a polarity opposite to that of the first and second MOS transistors, having a base being connected to the drain of the first MOS transistor, and having an emitter being connected to the gates of the first and second MOS transistors;

a first bias current source connected to the emitter of the first bipolar transistor; and a second bias current source connected to the emitter of the second bipolar transistor.

9. The current mirror circuit as defined in claim 6, wherein a diode is provided between the connecting point of the gates of the third and fourth MOS transistors to the first bias current source and the emitter of the first bipolar transistor.

10. The current mirror circuit as defined in claim 7, wherein a diode is provided between the connecting point of the gates of the third and fourth MOS transistors to the f first bias current source and the emitter of the first bipolar transistor.

11. The current mirror circuit as defined in claim 8, wherein a first diode is provided between the connecting point of the gates of the third and fourth MOS transistors to the first bias current source and the emitter of the first bipolar transistor.

12. The current mirror circuit as defined in claim 11, wherein a second diode is provided between the connecting point of the gates of the first and second MOS transistors to the second bias current source and the emitter of the second bipolar transistor.

13. The current mirror circuit as defined in claim 6, comprising:

a first output transistor of a bipolar type having a collector being connected to a drain of the fourth MOS transistor;

a second output transistor of a bipolar type having a polarity opposite to that of the first output transistor, having a base being connected to the collector of the first output transistor, and having an emitter given a bias by a predetermined current; and a third output transistor of a bipolar type having the same polarity as that of the first output transistor, having a base being connected to the emitter of the second output transistor, and having an emitter being connected to a base of the first output transistor.

14. The current mirror circuit as defined in claim 7, comprising:

a first output transistor of a bipolar type having a collector being connected to a drain of the fourth MOS transistor;

a second output transistor of a bipolar type having a polarity opposite to that of the first output transistor, having a base being connected to the collector of the first output transistor, and having an emitter given a bias by a predetermined current; and a third output transistor of a bipolar type having the same polarity as that of the first output transistor, having a base being connected to the emitter of the second output transistor, and having an emitter being connected to a base of the first output transistor.

15. The current mirror circuit as defined in claim 8, comprising:

a first output transistor of a bipolar type having a collector being connected to a drain of the fourth MOS transistor;

a second output transistor of a bipolar type having a polarity opposite to that of the first output transistor, having a base being connected to the collector of the first output transistor, and having an emitter given a bias by a predetermined current; and a third output transistor of a bipolar type having the same polarity as that of the first output transistor, having a base being connected to the emitter of the second output transistor, and having an emitter being connected to a base of the first output transistor.

16. The current mirror circuit as defined in claim 9, comprising:

a first output transistor of a bipolar type having a collector being connected to a drain of the fourth MOS transistor;

a second output transistor of a bipolar type having a polarity opposite to that of the first output transistor, having a base being connected to the collector of the first output transistor, and having an emitter given a bias by a predetermined current; and a third output transistor of a bipolar type having the same polarity as that of the first output transistor, having a base being connected to the emitter of the second output transistor, and having an emitter being connected to a base of the first output transistor.

17. The current mirror circuit as defined in claim 12, comprising:

a first output transistor of a bipolar type having a collector being connected to a drain of the fourth MOS transistor;

a second output transistor of a bipolar type having a polarity opposite to that of the first output transistor, having a base being connected to the collector of the first output transistor, and having an emitter given a bias by a predetermined current; and a third output transistor of a bipolar type having the same polarity as that of the first output transistor, having a base being connected to the emitter of the second output transistor, and having an emitter being connected to a base of the first output transistor.

* * * * *